US006099259A

United States Patent [19]

Monk et al.

[11] Patent Number: 6,099,259

[45] Date of Patent: Aug. 8, 2000

[54] VARIABLE CAPACITY COMPRESSOR

[75] Inventors: David T. Monk, Lebanon; Joe T. Hill, Bristol, both of Va.; Philip C. Wagner, Bristol, Tenn.; Joseph F. Loprete, Bristol, Tenn.; Michael R. Young, Bristol, Tenn.

[73] Assignee: Bristol Compressors, Inc., Bristol, Va.

[21] Appl. No.: 09/013,154

[22] Filed: Jan. 26, 1998

[51] Int. Cl.[7] ..... F04B 49/00

[52] U.S. Cl. ..... 417/15; 417/44.1; 417/45; 417/221; 417/326

[58] Field of Search ..... 417/15, 44.1, 45, 417/326, 321

[56] References Cited

U.S. PATENT DOCUMENTS

| | | | |
|---|---|---|---|
| 4,031,778 | 6/1977 | Fazekas . | |
| 4,236,874 | 12/1980 | Sisk . | |
| 4,242,626 | 12/1980 | Gross . | |
| 4,245,966 | 1/1981 | Riffe | 417/539 X |
| 4,248,053 | 2/1981 | Sisk . | |
| 4,396,359 | 8/1983 | Kropiwnicki . | |
| 4,409,532 | 10/1983 | Hollenbeck et al. | 318/749 |
| 4,472,670 | 9/1984 | Stanley . | |
| 4,479,419 | 10/1984 | Wolfe . | |
| 4,494,447 | 1/1985 | Sisk | 92/13.3 |
| 4,503,371 | 3/1985 | Sugita . | |
| 4,566,289 | 1/1986 | Iizuka . | |
| 4,598,764 | 7/1986 | Beckey . | |
| 4,687,982 | 8/1987 | Palaniappan . | |
| 4,718,247 | 1/1988 | Kobayashi et al. . | |
| 4,767,293 | 8/1988 | Caillat et al. . | |
| 4,838,769 | 6/1989 | Gannaway . | |
| 4,879,502 | 11/1989 | Endo et al. . | |
| 4,963,075 | 10/1990 | Albertson et al. . | |
| 5,070,932 | 12/1991 | Vlasak . | |
| 5,080,130 | 1/1992 | Terwilliger et al. . | |
| 5,106,278 | 4/1992 | Terwilliger et al. . | |
| 5,129,792 | 7/1992 | Abousabha . | |
| 5,201,640 | 4/1993 | Heinzelmann et al. . | |
| 5,203,857 | 4/1993 | Terwilliger et al. . | |
| 5,252,905 | 10/1993 | Wills et al. . | |
| 5,592,059 | 1/1997 | Archer . | |
| 5,619,860 | 4/1997 | Yuji et al. . | |
| 5,780,990 | 7/1998 | Weber . | |
| 5,951,261 | 9/1999 | Paczuski | 417/315 |

FOREIGN PATENT DOCUMENTS

| | | |
|---|---|---|
| 0 547351 A2 | 6/1993 | European Pat. Off. . |
| 3138812 | 4/1983 | Germany . |
| 4322223 | 1/1995 | Germany . |

OTHER PUBLICATIONS

Product Information, Definite Purpose Controls, Contactors, Starters, 2–Speed Controller, General Electric, GEA–11540B.

*Primary Examiner*—Timothy S. Thorpe
*Assistant Examiner*—Ehud Gartenberg
*Attorney, Agent, or Firm*—Finnegan, Henderson, Farabow, Garrett & Dunner, L.L.P.

[57] ABSTRACT

For a refrigerant compressor having two capacities, a camming structure operable in different manners depending on direction of crankshaft rotation, to achieve each capacity while providing top dead center piston operation thru the use of a circular cam bushing which is eccentrically, rotatably mounted on the crankshaft eccentric and within the connecting rod bearing wherein the combined eccentricities of the bushing and the eccentric equal the primary stroke of the piston. A first stop mechanism is provided for stabilizing the bushing on the eccentric upon rotation of the crankshaft in one direction whereby the eccentricities of the eccentric and bushing become aligned and remain so during synchronous rotational orbiting motion of the eccentric and bushing during rotation of the crankshaft for producing full stroke and full capacity. A second stop mechanism is provided for stabilizing the bushing within the bearing upon opposite rotation of the crankshaft whereby the bushing eccentricity becomes and remains substantially aligned with the connecting rod stroke axis while the eccentric moves alone thru its rotational orbit for producing reduced stroke and reduced capacity. A unique electrical control system is also provided for a reversible electric induction motor for selectively and efficiently driving the compressor crankshaft in either direction for providing the different capacities.

6 Claims, 3 Drawing Sheets

VARIABLE CAPACITY COMPRESSOR

BACKGROUND OF THE INVENTION

1. Field

The present invention is concerned with variable capacity compressors, vacuum or other pumps or machines, and particularly those reciprocating piston compressors used in single or multiple cylinder refrigeration, air conditioning systems or heat pumps or the like, including machines such as scotch yoke compressors of U.S. Pat. No. 4,838,769, wherein it is desirable to vary the compressor output, i.e., compressor capacity modulation, in accordance with cooling load requirements. Such modulation allows large gains in efficiency while normally providing reduced sound, improved reliability, and improved creature comforts including one or more of reduced air noise, better de-humidification, warmer air in heat pump mode, or the like.

One approach to achieving modulation has been to switch the stroke length, i.e., stroke, of one or more of the reciprocating pistons whereby the volumetric capacity of the cylinder is changed. In these compressors the reciprocating motion of the piston is effected by the orbiting of a crankpin, i.e., crankshaft eccentric, which is attached to the piston by a connecting rod means of any of a variety of structures or configurations and which has a bearing in which the eccentric is rotatably mounted.

2. Prior Art

A proposed mechanism in the published art for switching stroke is the use of a cam bushing mounted on the crankshaft eccentric, which bushing when rotated on the eccentric will shift the orbit axis of the connecting rod bearing radially and parallelly with respect to the crankshaft rotational axis and thus reduce or enlarge the rod bearing orbit radius which changes the piston stroke accordingly.

A difficult problem attends such cam action mechanism in that at reduced stroke the piston does not attain full or primary stroke top-dead-center (TDC) positioning within the cylinder and greatly diminished compression and considerable reexpansion of the only partially compressed refrigerant gas occurs. The efficiency of the compressor is thus markedly compromised.

Such cam mechanisms are shown and described in U.S. patents: U.S. Pat. Nos. 4,479,419; 4,236,874; 4,494,447; 4,245,966; and 4,248,053, the disclosures of which with respect to general compressor construction and also with respect to particular structures of cylinder, piston, crankshaft, crankpin and throw shifting mechanisms are hereby incorporated herein by reference in their entirety. With respect to these patents the crankpin journal is comprised of an inner and one or more outer eccentrically configured journals, the inner journal being the outer face of the crankpin or eccentric, and the outer journal(s) being termed "eccentric cams or rings" in these patents, and being rotatably mounted or stacked on the inner journal. The bearing of the connecting rod is rotatably mounted on the outer face of the outermost journal.

In these patents, as in the present invention, all journal and bearing surfaces of the coupling structure or power transmission train of the shiftable throw piston, from the crankshaft to the connecting rod are conventionally circular.

OBJECTS OF THE INVENTION

Objects therefore of the present invention are: to provide an improved coupling structure for a crankpin throw shifting mechanism for a single or multicylinder compressor wherein the piston always achieves primary TDC position regardless of the degree of stroke change; to provide such coupling structure as a structurally simple mechanism which can be manufactured to give any desired compressor capacity shift; to provide such coupling structure to give different strokes for two or more pistons of multi-cylinder compressors to give a wide range of desired variations in compressor capacity without reducing compressor efficiency thru significant volume clearance, i.e., clearance between the piston top and valve plate at TDC; and to provide a motor control circuit that can be used to advantage with the present invention to achieve markedly improved overall efficiency of operation.

SUMMARY OF THE INVENTION

These and other objects hereinafter becoming evident have been attained in accordance with the present invention thru the discovery of a unique, simple and reliable coupling structure for functionally connecting a connecting rod bearing and a crankshaft eccentric. This structure is adapted to change the primary stroke of a piston while always effecting primary top dead center positioning of said piston on its up-stroke regardless of the stroke change. This structure comprises a circular cam bushing which is eccentrically, rotatably mounted on said eccentric and within said bearing wherein the combined eccentricities of said bushing and said eccentric equal the primary stroke of said piston. A first stop moans is provided for stabilizing said bushing on said eccentric upon rotation of said crankshaft in one direction whereby the eccentricities of said eccentric and bushing become aligned and remain so during synchronous orbiting motion of said eccentric and bushing during said rotation of said crankshaft. A second stop means is provided for stabilizing said bushing within said bearing upon reversing rotation of said crankshaft whereby the bushing eccentricity becomes and remains substantially aligned with a stroke axis of said connecting rod while said eccentric moves alone thru its orbit In certain preferred embodiments:

(a) the first stop means comprises cooperating shoulders on the bushing and the crankshaft, and the second stop means comprises cooperating shoulders on the bushing and bearing, the first and second stop means becoming alternately functional upon opposite rotations of the crankshaft; and (b) the eccentricities of said bushing and said eccentric are substantially equal whereby the cylinder capacity can be switched from full to substantially one half upon reversing the crankshaft rotation.

BRIEF DESCRIPTION OF THE DRAWINGS

The invention will be understood further from the drawings herein which are not drawn to scale and in which certain structural portions are exaggerated in dimension for clarity, and from the following description wherein.

DETAILED DESCRIPTION

Figure 1:
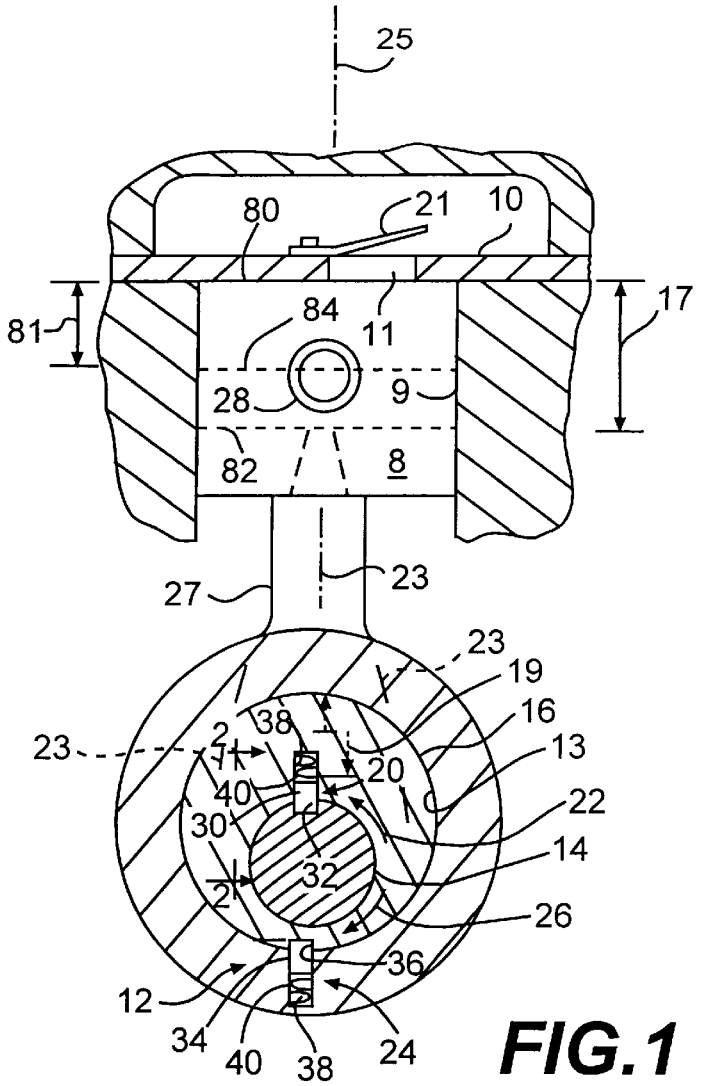
FIG. 1 is a partially cross-sectional view of portions of a refrigerant compressor, illustrating a piston in the top dead center position.

Referring to the drawings and with particular reference to the claims hereof, one of the present coupling structures generally designated 12 is shown as an example in a refrigerant compressor having a piston 8 mounted in a cylinder 9, and having a reed type discharge valve 21 mounted on a valve plate 10 having a discharge port 11 therethrough. The coupling structure for mounting a connecting rod which pivotally mounted on piston 8 by wrist pin 28 and having a bearing 13, comprises an eccentric 14 of a crankshaft 15, a circular cam bushing 16 eccentrically, rotatably mounted on said eccentric 14 and within said bearing 13 wherein the combined eccentricities 19 and 18 of said bushing and said eccentric respectively equal the primary stroke length 17 of piston 8 between a top dead center ("TDC") position 80 and a first bottom position 82, first stop means generally designated 20 for angularly stabilizing said bushing on said eccentric upon rotation of said crankshaft in one direction 22 whereby the eccentricities of said eccentric and bushing become aligned and remain so during synchronous orbiting motion of said eccentric and bushing during said rotation, and second stop means generally designated 24 for angularly stabilizing said bushing within said bearing upon reverse rotation 26 of said crankshaft whereby the bushing eccentricity becomes and remains substantially aligned with the piston stroke axis 25 while said eccentric moves alone thru its orbit to move piston 8 through a reduced stroke length 81 between TDC position 80 and a second bottom position 84.

It is noted that as the eccentric 14 moves alone thru its orbit during reduced stroke the bushing eccentricity 19 will be swung back and forth to each side of the piston stroke axis 25, but as indicated by the approximate dotted lines 23, the bushing eccentricity will remain substantially aligned with the connecting rod axis 23.

The first stop means 20 comprises cooperating shoulder means such as pin 30 on said bushing and shoulder 32 machined into said eccentric, and wherein said second stop means 24 comprises cooperating shoulder means such as pin 34 on said bearing and shoulder 36 machined into said bushing. The pins 30 and 34 are continually urged radially inwardly from their sockets 38 by compression springs 40.

Figure 3:
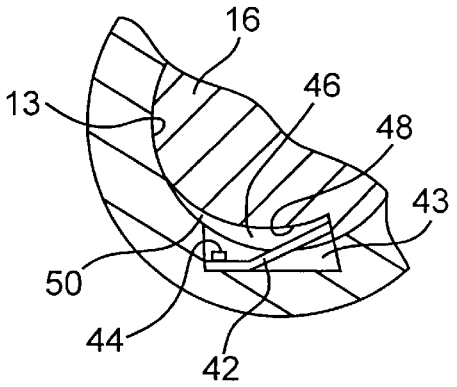
FIG. 3 is an enlarged view of a segment of FIG. 1 showing a variation in the stop mechanism structure.

As an alternative stop mechanism, as shown in FIG. 3, a leaf-type spring or equivalent structure 42 is affixed by screw 44 or the like in a slot 43 machined into bearing 13 and is normally sprung into slot 46 machined into bushing 16. As bushing 16 orbits counterclockwise, spring 42 is flexed radially outwardly in to slot 43. It is noted that spring 42 and slot 46 can be dimensioned such that the spring does not strike against the slot floor 48 upon each counterclockwise orbit of the eccentric and bushing and create objectionable clicking sound. Also in this regard, the radius 50 of the exit from slot 46 further reduces or eliminates any noise created by contact of spring 42 with the bushing. Such structure can also be used for the eccentric-to-bushing junction.

Figure 4:
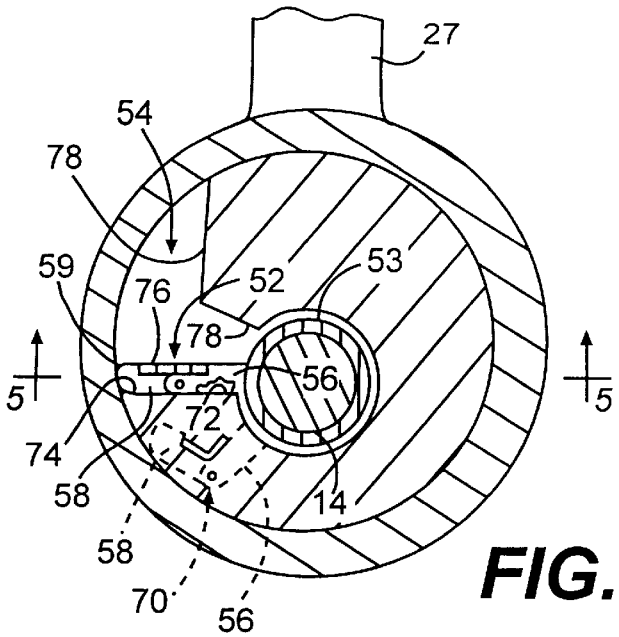
FIG. 4 is an enlarged view as in FIG. 1 taken along line 4—4 of FIG. 5 in the direction of the arrows and showing a variation in the stop mechanism.
Figure 5:
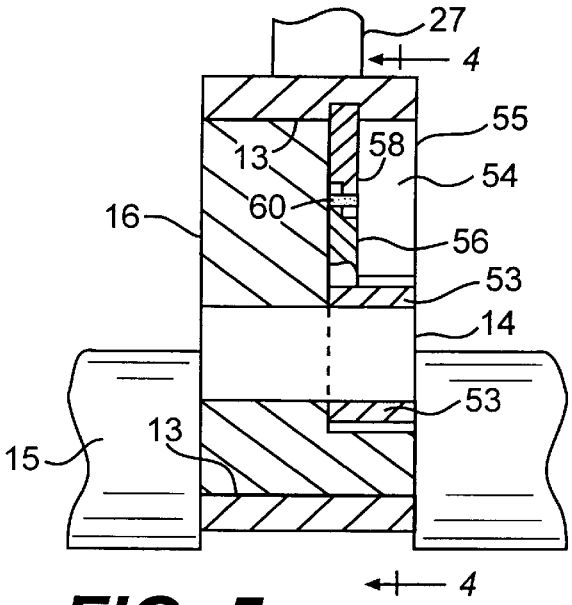
FIG. 5 is a cross sectional view taken along line 5—5 of FIG. 4 in the direction of the arrows and rotated 90° in the plane of the drawing sheet.
Figure 6:
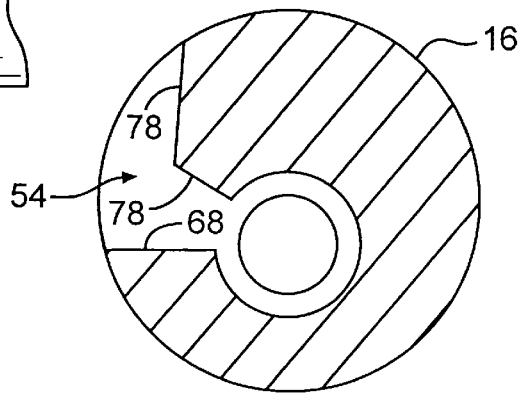
FIG. 6 is an isolated view of the cam bushing per se of FIG. 5.

Referring to FIGS. 4–6, a further variation of the stop structure is shown as being operable thru a break-down linkage which eliminates unnecessary contact of the stop with a rotating structure. In this embodiment as applied, for example, to the cam bushing and rod bearing, a stop arm generally designated 52 is affixed to a sleeve 53 rotatably mounted on eccentric 14 within a recess 54 in a face 55 of cam bushing 16. Arm 52 is comprised of an inner section 56 affixed to sleeve 53 and an outer stop section 58 providing a stop end 59. Sections 56 and 58 are pivotally connected by a hinge pin 60.

In the operation the stop mechanism of FIGS. 4–6 with the motor and crankshaft rotating in a clockwise direction for reduced stroke wherein only the eccentric will orbit clockwise, the eccentric will drag bushing 16 also clockwise to engage its recess edge 68 with stop arm 52 and move it and straighten it from its dotted line neutral position 70 to its operative stopping position 72 as shown in FIG. 4 wherein end 59 is set into socket 74. This action locks the cam bushing 16 to the rod bearing at the precise position that the eccentricity of bushing 16 is aligned with the stroke axis 23 of the connecting rod to assure TDC. A light spring 76 affixed to the top of one of the sections 56 or 58 and slidable on the other may be used to urge section 58 downwardly (as viewed in the drawing) to assist in its insertion into socket 74. Other springs such as a torsional spring mounted over an extension of pivot pin 60 may also be used.

Reversal of the motor and crankshaft direction to a counterclockwise rotation for full stroke will forcibly rotate bushing 16 to engage its recess edge 78 with arm 52 and break it down easily against the force of spring 76 as indicated by the dotted line positions 70 of arm sections 56 and 58 in FIG. 4. This action, at precisely said positions 70, will maintain alignment of the eccentricities of 16 and 14 in cooperation with the stop means which operatively connects eccentric 14 and bushing 16 for simultaneous orbiting to ensure TDC.

It is apparent that the present invention in its broad sense is not limited to the use of any particular type of stop structure and the components of the stops shown herein can be reverse mounted, e.g., the spring 40 and pin 34 can be mounted in the cam bushing and the shoulder 36 cut into the bearing.

Figure 2:
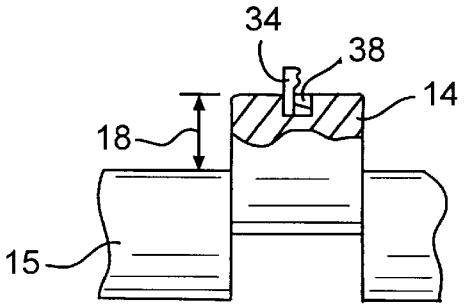
FIG. 2 is a view of a section of the crankshaft and eccentric (crankpin) taken along line 2—2 in FIG. 1.

In the embodiment shown, in FIGS. 1 and 2 the eccentricities of the bushing and the eccentric are substantially equal whereby the cylinder capacity can be switched from full to substantially one half upon reversing the crankshaft rotation.

It is particularly noted that the first and second stop means or stop mechanisms may be positioned at any angular position around the crankpin and bushing, and around the bushing and bearing respectively as long as the two eccentricities are aligned for full stroke, and the bushing eccentricity is substantially aligned with the connecting rod stroke axis for the reduced stroke.

A unique electrical circuit has been developed for controlling the reversible motor and may be employed in a preferred embodiment of the invention as described below in connection with a single cylinder compressor, the circuit being shown schematically in FIGS. 7 and 8.

Figure 7:
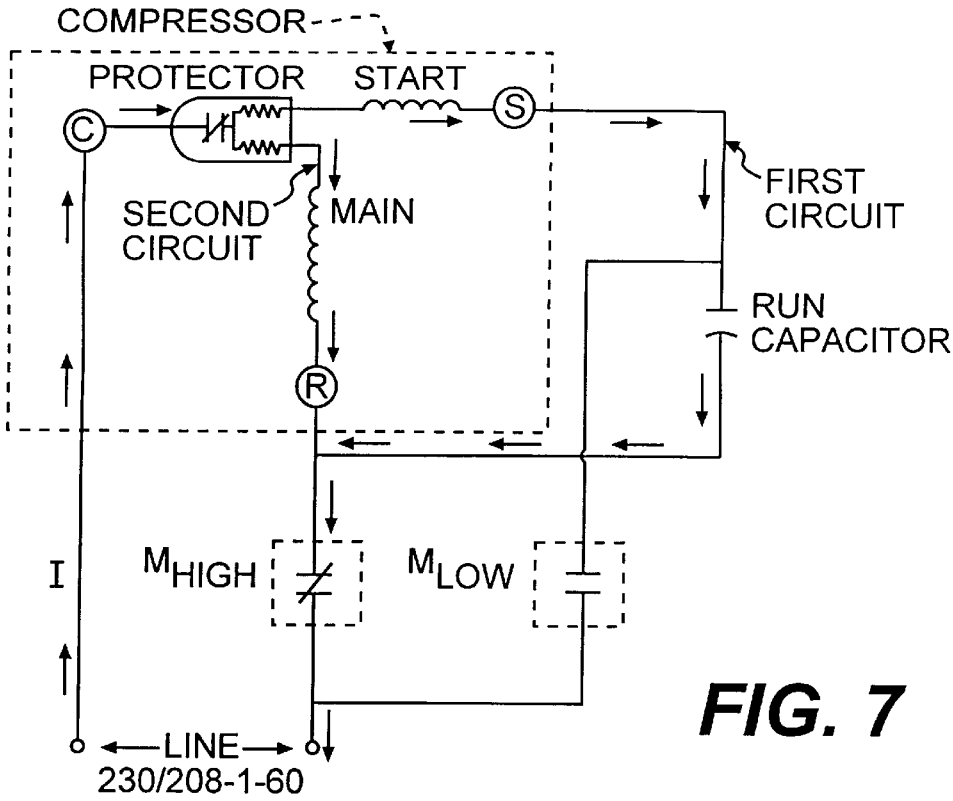
FIG. 7 is a motor control schematic for full capacity compressor operation.

The control schematic of FIG. 7 is equivalent to industry conventional PSC (permanent, split capacitor) wiring schematics using predetermined power supply. Line 1 runs through the common terminal (C) which leads into the motor protection. After leaving the motor protection, the current flow will split, going through both the start (S) and main, i.e., run (R) windings with M (motor) High contactor closed. This stage will be using the run winding as the main winding and places the run capacitor in series with the start winding, obtaining standard motor rotation with the piston fully active, i.e., full capacity operation.

Figure 8:
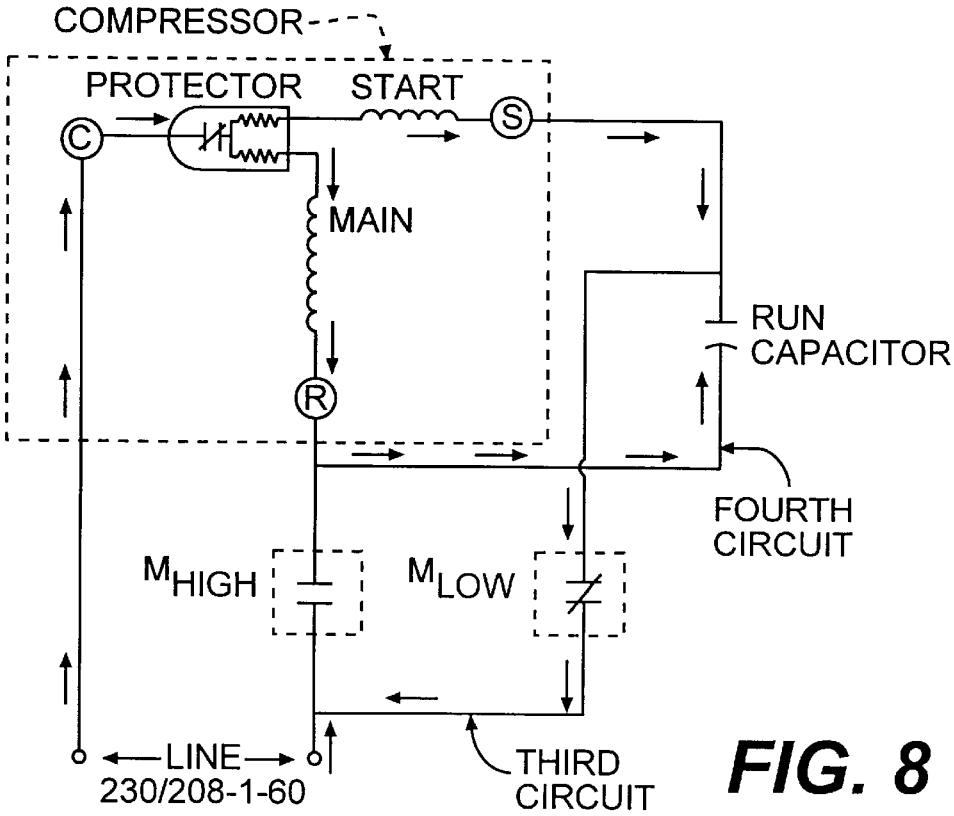
FIG. 8 is a motor control schematic for motor reversal and reduced capacity compressor operation.

The present unique Control Schematic of FIG. 8 employs a predetermined power supply depending on application. Line one will run through the common terminal (C), which leads to the motor protection. After leaving the motor protection, the current flow separates going through both the original start and original main windings with M low contactor energized. The compressor will now be using the start winding as the main and placing the run capacitor in series with the original main winding. Run capacitor placement in this mode facilitates both motor and mechanical rotation changes and simultaneously reduces motor strength to match the resulting reduced piston stroke, thus maximizing motor efficiency for the reduced load. It is particularly noted that for certain applications the original main winding and start capacitor, in reduced compressor capacity mode, may be taken off-line by a centrifugal switch or the like after the motor attains operational speed.

Suitable exemplarly solenoid actuated contactors or switches for use as the "switching means" of the present invention are shown and described in the General Electric, Product information brochure GEA-11540B 4/87 15M 1800, entitled "Definite Purpose Controls", 23 pages, the disclosure of which is hereby incorporated herein by reference in its entirety.

As best known at this time for use with a single cylinder compressor described below, the power unit would employ the following structures and operating characteristics:

Motor—reversible, squirrel cage induction, PSC, 1–3 hp;

Protector—Protects against overload in both load modes. Senses both T° and current;

| | |
|---|---|
| Run Capacitor | 35 $\mu$F/370 VAC; |
| Speed (rated load) | 3550 rpm; |
| Motor Strength | 252 oz. ft. Max/90 oz. ft. rated load; |

Power Supply—Single or three phase of any frequency or voltage, e.g., 230V—60 $H_z$ single phase, or 460V—80 $H_z$ three phase;

Switching Mechanism—control circuit which is responsive to load requirements to operate solenoid contactor and place the run capacitor in series with either the start winding or main winding, depending on the load requirements.

The compressor would have substantially the following structure and operating characteristics:

| | |
|---|---|
| (a) size (capacity) | 3 Ton; |
| (b) number of cylinders | One; |
| (c) cylinder displacement at full throw | 3.34 $in^3$/rev; |
| (d) full stroke length | 0.805 in.; |
| (e) normal operating pressure range in full stroke mode | 77 to 297 Psig; |

The invention has been described in detail with particular reference to preferred embodiments thereof, but it will be understood that variations and modifications will be effected with the spirit and scope of the invention.

We claim:

1. A coupling structure for functionally connecting a rod bearing of a connecting rod for a piston to a crankshaft eccentric, said structure comprising:

a circular cam bushing which is eccentrically, rotatably mounted on said eccentric and within said rod bearing wherein the combined eccentricities of said bushing and said eccentric equal the primary stroke of said piston;

a first stop mechanism for stabilizing said bushing on said eccentric upon rotation of said crankshaft in one direction whereby the eccentricities of said eccentric and bushing become aligned and remain so during synchronous rotational orbiting motion of said eccentric and bushing during said rotation of said crankshaft for producing a full stroke of the piston between a top dead center position and a first bottom position; and a second stop mechanism for stabilizing said bushing within said bearing upon opposite rotation of said crankshaft whereby the bushing eccentricity becomes and remains substantially aligned with a stroke axis of said rod while said eccentric moves alone and freely rotates thru its rotational orbit for producing a reduced stroke of the piston between said top dead center position and a second bottom position above the first bottom position;

wherein said structure is configured to change the primary stroke length of the piston while effecting the top dead center position regardless of the stroke length change.

2. The coupling structure of claim 1 wherein said first stop mechanism comprises cooperating shoulders on said bushing and said crankshaft, and wherein said second stop mechanism comprises cooperating shoulders on said bushing and said bearing, said first and second stop mechanism becoming alternately functional upon opposite rotations of said crankshaft.

3. The coupling structure of claim 2 wherein said eccentricities of said bushing and said eccentric are substantially equal whereby the cylinder capacity can be switched from full to substantially one half upon reversing the crankshaft rotation.

4. A gas compressor having a coupling structure for functionally connecting a rod bearing of a connecting rod means to an eccentric crankpin of a crankshaft, said crankshaft being rotated by a reversible AC motor, said structure being adapted to change the primary stroke length of a piston mounted on said rod means by reversing said motor rotation while affecting primary top dead center positioning of said piston on its up stroke regardless of the stroke length change, wherein said structure comprises a circular cam bushing which is eccentrically, rotatably mounted on said crankpin and within said rod bearing wherein the combined eccentricities of said cam and said crankpin equal the primary stroke of said piston, a first stop mechanism for stabilizing said cam on said crankpin upon rotation of said crankshaft in one direction whereby the eccentricities of said crankpin and cam become aligned and remain so during synchronous rotational orbiting motion of said crankpin and cam during said rotation of said crankshaft for producing full stroke, and a second stop mechanism for stabilizing said cam within said bearing upon opposite rotation of said crankshaft whereby the cam eccentricity becomes and remains substantially aligned with a stroke axis of said rod while said crankpin moves alone and freely rotates thru its rotational orbit for producing reduced stroke.

5. The coupling structure of claim 1, wherein the structure is incorporated into a compressor with a reciprocating piston in a cylinder and a valve plate at the top of the cylinder and when the top dead center position of the piston is closely adjacent the valve plate, whereby the compressor operates at optimum efficiency in both the full and reduced strokes.

6. The coupling structure of claim 1, wherein the first stop mechanism comprises a shoulder on said crankshaft, a first pin disposed in the bushing, and a spring biasing the first pin against the crankshaft such that the first pin engages the shoulder on the crankshaft when the crankshaft rotates in the one direction and wherein the second stop mechanism comprises a shoulder on said bushing, a second pin disposed in the bearing, and a spring biasing the second pin against the bushing such that the second pin engages the shoulder on the bushing when the crankshaft rotates in the opposite direction.

* * * * *